US005953755A

United States Patent [19]

Barylski

[11] Patent Number: 5,953,755

[45] Date of Patent: Sep. 21, 1999

[54] NECKTIE HOLDER AND METHOD OF MAKING SAME

[76] Inventor: Gary S. Barylski, 3715 E. Cleveland Rd., Huron, Ohio 44839

[21] Appl. No.: 08/985,194

[22] Filed: Dec. 4, 1997

[51] Int. Cl.[6] ..... A41D 25/02

[52] U.S. Cl. ..... 2/148; 2/149; 2/150; 2/152.1; 2/153

[58] Field of Search ..... 2/144, 148, 149, 2/150, 151, 152.1, 153, 902, 48, 50, 51, 52, 114

[56] References Cited

U.S. PATENT DOCUMENTS

| | | |
|---|---|---|
| 2,244,692 | 6/1941 | Hall . |
| 2,735,106 | 2/1956 | Mercer . |
| 3,665,519 | 5/1972 | Calhoun, Sr. . |
| 4,748,692 | 6/1988 | Fukushima . |
| 5,084,916 | 2/1992 | Austin . |
| 5,416,926 | 5/1995 | Koy . |

FOREIGN PATENT DOCUMENTS

| | | | |
|---|---|---|---|
| 11691 | 1/1909 | Denmark | 2/152 A |
| WO 79/00894 | 11/1979 | WIPO | 2/150 |

*Primary Examiner*—Jeanette Chapman
*Attorney, Agent, or Firm*—Richard C. Litman

[57] ABSTRACT

A necktie holder and method of making the same. The holder is made of two pieces including a one-piece sleeve and a one-piece retainer. The one-piece sleeve is generally frusto-conical with a large diameter top and a smaller diameter bottom. A slot in the sleeve extends from the top to the bottom for receiving the both ends of the necktie. A one-piece retainer is placed in the slot to hold the necktie therein. As the sleeve and retainer are fitted loosely about the necktie, the holder is easily moved up and down to adjust its position. The sleeve is formed by a single sheet of metal or plastic that is rolled into a frusto-conical shape with a vertical slot therein. The retainer is constructed from a one-piece section of material having an H-shaped cross section.

17 Claims, 3 Drawing Sheets

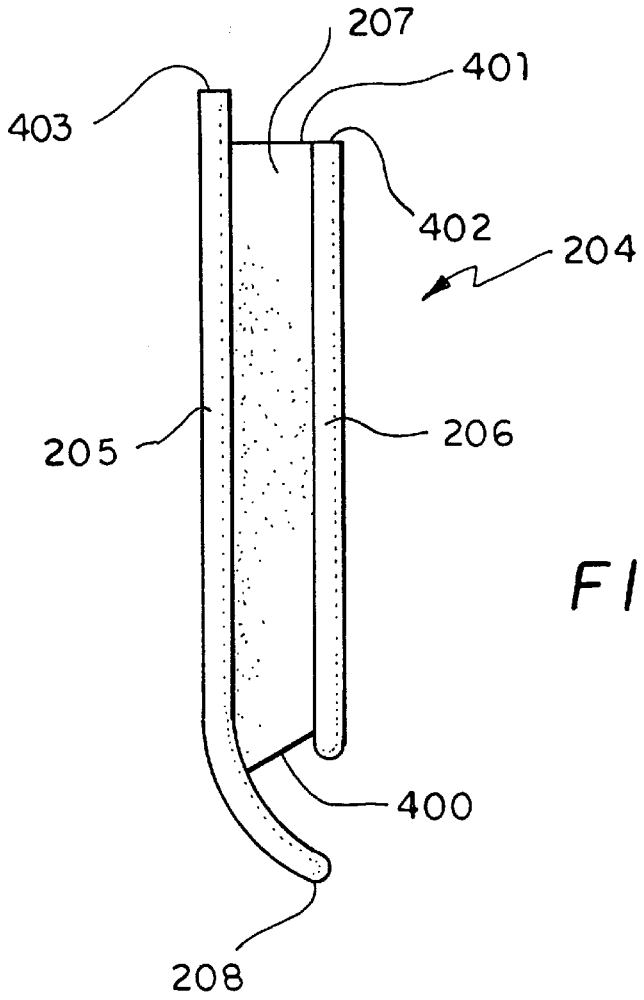
FIG. 4
FIG. 5
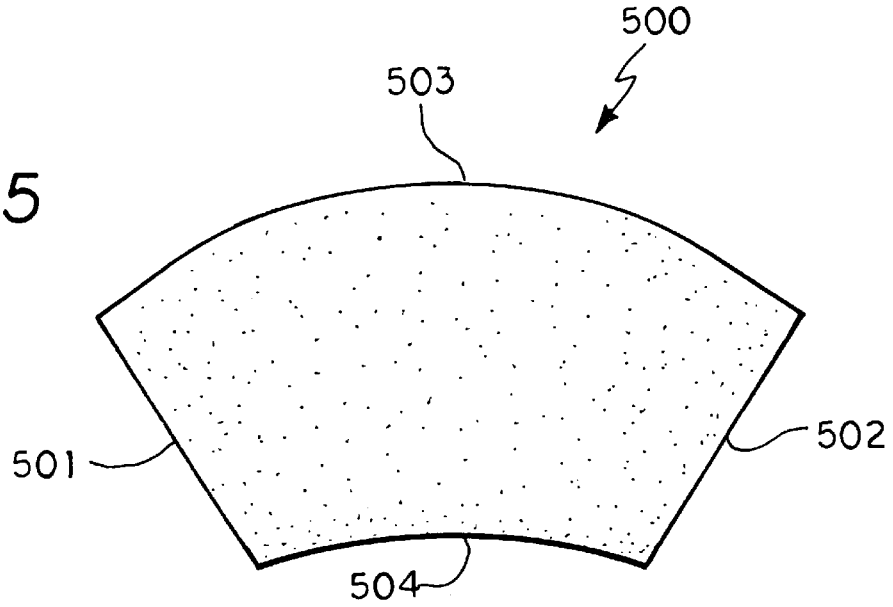

NECKTIE HOLDER AND METHOD OF MAKING SAME

BACKGROUND OF THE INVENTION

1. Field of the Invention

The present invention relates to a knot simulating, necktie holder and a method of making the necktie holder and, more specifically, to a holder for a necktie that holds the necktie in position, while allowing adjustment of the necktie, and without damaging the material of the tie itself.

2. Description of the Related Art

Simulated knot holders for neckties allow individuals to wear neckties without having to tie them. The prior art devices, however, tend to damage the material of the tie itself, and/or require complex assembly. In addition, the known holders grip the material of the necktie too firmly to allow easy adjustment of the necktie.

U.S. Pat. No. 2,244,692 issued on Jun. , 1941 to Hall teaches a necktie having a "preformed" knot. A hollow tubular structure engages both ends of a necktie and is secured via an insertion which frictionally engages the tie to hold the knot in place. The simulated knot is an integral portion of the tie, and is not therefore usable with other neckties. U.S. Pat. No. 2,735,106 issued on Feb. 21, 1956 to Mercer discloses a combined necktie holder and knot that clamps the tie between two members. The clamping mechanism does not allow for a loose comfortable fit or adjustment of the location of the knot. U.S. Pat. No. 3,665,519 issued on May 30, 1972 to Calhoun, Sr. teaches a simulated necktie knot wherein a knot-shaped member engages both ends of a tie and directs them through a slot in the back. The simulated knot is maintained by a wedge and ball arrangement which frictionally engages the tie. As with the Mercer device, this device does not allow for a loose comfortable fit or adjustment of the location of the knot.

U.S. Pat. No. 4,748,692 issued on Jun. 7, 1988 to Fukushima and U.S. Pat. No. 5,084,916 issued on Feb. 4, 1992 to Austin, both show a necktie having an integral clasping portion. The clasping portions are designed for use only with their associated type of tie. U.S. Pat. No. 5,416,926 issued on May 23, 1995 to Koy teaches a support for a tied necktie. This device requires that the necktie have a knot placed therein, and therefore is not adjustable. Danish Patent No. 11,691 discloses a clipping mechanism that forms a simulated knot for a necktie. The mechanism has sharp edges, and clamps the tie which could result in damage to the material of the tie. International Patent Application No. WO 79/00894 shows an adjustable simulated knotted necktie that includes an elaborate strap and knot arrangement. The tie must be removed by unsnapping the strap.

None of the above inventions and patents, taken either singularly or in combination, is seen to describe the instant invention as claimed. Thus a necktie holder solving the aforementioned problems is desired.

SUMMARY OF THE INVENTION

The knot simulating, necktie holder of the present invention alleviates the above noted problems by holding a necktie in position without clamping the material of the necktie, thus allowing easy adjustment of the necktie, and avoiding damaging the material of the necktie itself. The holder is made of two pieces including a one-piece sleeve and a one-piece retainer. When the holder is attached to a tie, the holder simulates a knot as is normally tied into a necktie. The one-piece sleeve is generally frusto-conical in configuration with a large diameter top and a smaller diameter bottom. A slot in the sleeve extends from the top to the bottom for receiving the both ends of the necktie.

After the necktie is placed through the slot and into the sleeve, the one-piece retainer is placed in the slot to hold the necktie therein. As the sleeve and retainer are fitted loosely about the necktie, the holder is easily moved up and down to adjust its position. The loose fit also allows adjustment of the visible end of the necktie relative to the hidden end. This not only reduces the time to "tie" a necktie, but also aids those unable to tie a necktie in the customary fashion, (young children, handicapped individuals, etc.).

A major advantage of the present invention is the simple and inexpensive method of manufacturing both the retainer and the sleeve. The sleeve is formed by a single sheet of lightweight metal or plastic that is rolled into a frusto-conical with a vertical slot therein. The retainer is constructed from a one-piece section of plastic material having an H-shaped cross section is used. The H-shaped cross sectional material is first cut to an appropriate length. Several additional cuts are made and portions of the retainer are rounded to remove rough edges. A lip is formed in the retainer to help hold the sleeve and retainer together. As the sheet material of the sleeve and the H-shaped cross sectional material are both commercially available, the construction of the holder is simple and inexpensive. As both the retainer and sleeve are light in weight, the holder will not tend to slide down the tie from the force of gravity alone, even with the loose-fit construction.

Accordingly, it is a principal object of the invention to provide a knot simulating, necktie holder that is easy to adjust.

It is another object of the invention to provide a knot simulating, necktie holder that allows a necktie to be easily adjusted after the holder is in position.

It is a further object of the invention to provide an economical and simple method of producing a knot simulating, necktie holder.

It is an object of the invention to provide improved elements and arrangements thereof in a necktie holder for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4 is an enlarged scale, side view of the retainer shown in FIG. 2.

FIG. 5 is an enlarged scale, front view of the retainer sleeve shown in FIG. 2, prior to being folded into its final shape.

Similar reference characters denote corresponding features consistently throughout the attached drawings.

DETAILED DESCRIPTION OF THE PREFERRED EMBODIMENT

Figure 1:
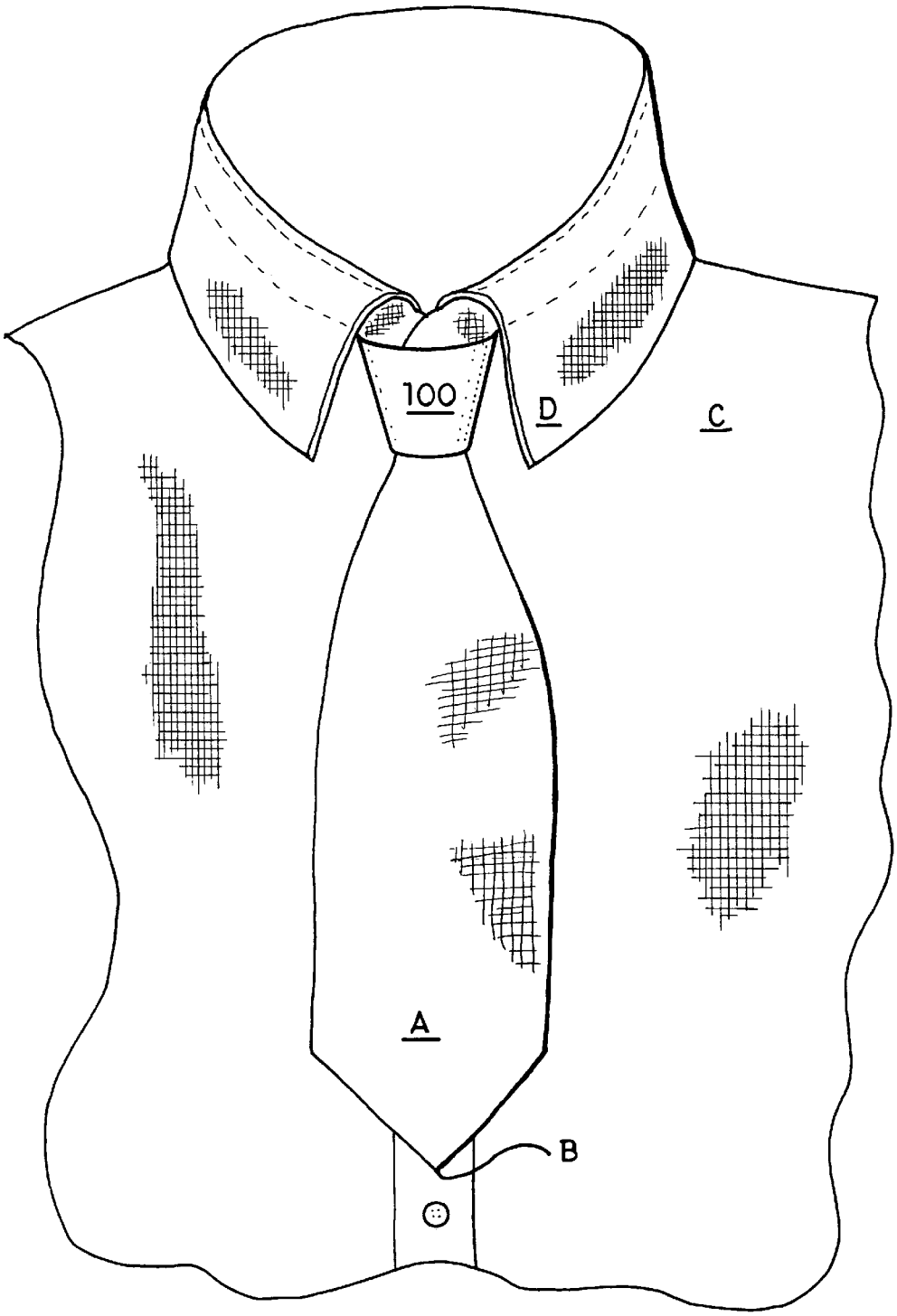
FIG. 1 is an environmental view of a necktie being supported by the necktie holder of the present invention.

The present invention is a two-piece, simulated knot, necktie holder including a one-piece sleeve and a one-piece retainer. As shown in FIG. 1, when the holder 100 is attached to a tie, the holder has the shape of a knot as normally tied into a necktie A. The details of the sleeve and retainer are better seen in FIGS. 2–5. The one-piece sleeve 200 is generally frusto-conical with a large diameter top 201 and a smaller diameter bottom 202. A slot 203 extends from the top 201 to the bottom 202 for receiving the retainer 204.

Figure 2:
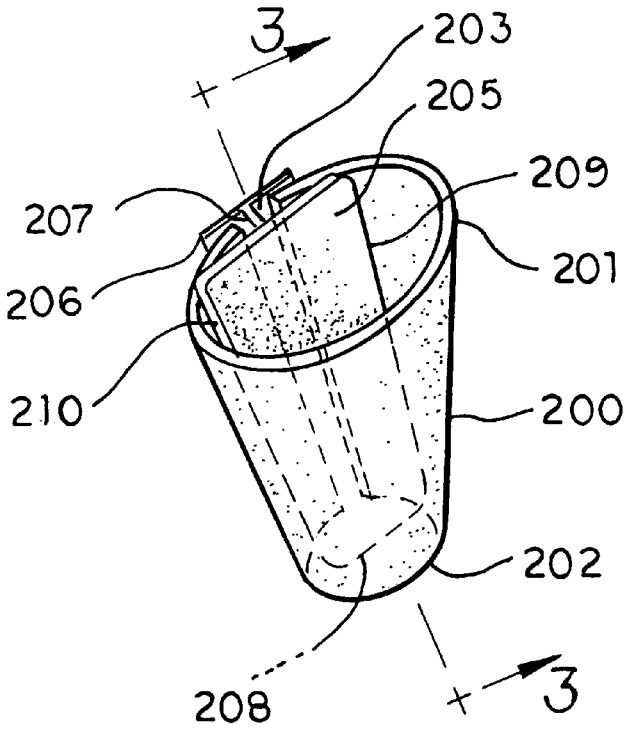
FIG. 2 is an exploded perspective view of the necktie holder showing the sleeve and the retainer.

The one-piece retainer 204 has a first generally planar portion 205, a second generally planar portion 206 and a connecting rib 207. The rib 207 connects the first generally planar portion 205 to the second generally planar portion 206 along a central axis. The bottom edge 400 of the rib 207 is slanted, with the long edge of rib 207 being connected to the first generally planar portion 205, and the short edge of the rib 207 being connected to the second generally planar portion 206. The top edge 401 of the rib 207 is flush with the top edge 402 of the second generally planar portion 206. The top edge 403 of the first generally planar portion 205 extends farther upwards than the top edge 401 of the rib 207 and the top edge 402 of the second generally planar portion 206. The bottom edge of both the first generally planar portion 205 and the second generally planar portion 206 extend farther downwards than the bottom edge 400 of the rib 207. The bottom of the first generally planar portion 205 is bent toward the second generally planar portion 206, to form a lip 208. As is best seen in FIG. 2, lip 208 is rounded to reduce friction between the retainer and the sleeve as they are connected.

Figure 3:
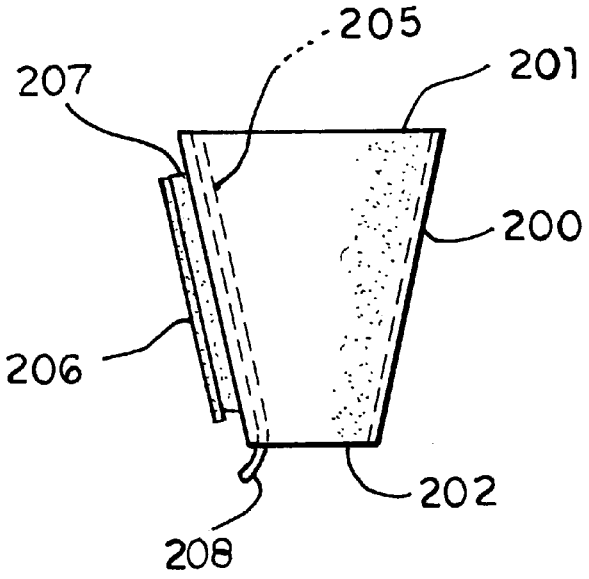
FIG. 3 is a cross sectional view of the sleeve and the retainer, taken through line 3—3 in FIG. 2.

FIG. 3 shows the retainer 204 and sleeve 200 in their connected position, while FIG. 1 shows the holder 100 in its necktie supporting position. After the necktie is wrapped around the neck of the wearer, (under the collar D of shirt C) both strands of the necktie are placed through the slot 203 in the sleeve 200. The rib 207 of the retainer 204 is then guided into the slot 203 from the top of the sleeve 200. Sides 209 and 210 of the first generally planar portion 205 are tapered at an angle substantially equal to the internal taper of sleeve 200. When the retainer 204 is fully inserted, sides 209 and 210 contact the inside of sleeve 200 to limit the downward movement of the retainer 204, while the lip 208 extends below and curves around the bottom 202 of the sleeve 200 to thereby hold the retainer 204 and the sleeve 200 together. Once the retainer 204 and sleeve 200 are joined, the holder 100 can be positioned for the desired appearance and comfort. This is due to the loose fit between the holder 100 and the necktie A; this loose fit being one of the major advantages of the present invention over prior art devices. In addition to allowing the holder to be repositioned, the loose fit also permits the ends of the necktie A to be moved relative to each other. Thus the front of the necktie A can be adjusted so that the tip B of the necktie A is at the desired position.

Another advantage of the present invention is the simple and inexpensive method of manufacturing the holder 100. Both the retainer 204 and the sleeve 200 are of one-piece construction. The sleeve 200 is formed by a single sheet of metal or plastic 500 as shown in FIG. 5. The sheet 500 is rolled until side 501 is parallel with side 502 to form slot 203. Once the sheet 500 is bent into this shape, side 503 becomes the top 201 of the sleeve 200 and side 504 becomes the bottom 202 of the sleeve 200. Many well known plastic and metal working procedures can be used to roll the sheet (i.e. heating, bending about a form, etc.), without departing from the scope of the present invention.

To form the one-piece retainer 204, a one-piece section of plastic material having an H-shaped cross section is used. This type of material, (usually formed by extruding), is currently available as a joint molding strip for ¼" paneling. The H-shaped cross sectional material is first cut to an appropriate length (from the top edge 403 of the first generally planar portion 205 to the end of lip 208). A second cut is made through the second generally planar portion 206 and the connecting rib 207. the second cut makes the second generally planar portion 206 flush with the connecting rib 207 and slightly shorter than the first generally planar portion 205. The sides of the first generally planar portion 205 are tapered such that the top of portion 205 is wider than the bottom of portion 205. At the bottom of portion 205, the material is rounded and bent toward the second generally planar portion 206 to form the lip 208 (best seen in FIGS. 2 and 4). The bottom 400 of the connecting rib 207 is cut at a slant such that the rib 207 is longer where it contacts the first generally planar portion 205, and shorter where it contacts the second generally planar portion 206. Finally, the edges of both the lip 208 and the bottom of the second generally planar portion 206 are rounded off (best seen in FIG. 4). The slant in rib 207, the rounded lip 208 and the rounded edges of the lip 208 and the bottom of the second generally planar portion 206, all reduce the friction when the rib 207 is slid into slot 203.

The light weight semi-rigid material used to make the retainer and sleeve results in a light weight holder that will not slide down the necktie due to the force of gravity alone. Various sizes of necktie holders may be made using the above method, (to fit a number of different size neckties) with the retainer and sleeve being sized to cooperate with each other. The resulting necktie holder gives the appearance of a standard tie-knot without the inconveniences thereof.

It is to be understood that the present invention is not limited to the embodiment described above, but encompasses any and all embodiments within the scope of the following claims.

I claim:

1. A necktie holder comprising:

a one-piece sleeve having a generally frusto-conical shape with a large diameter top and a smaller diameter bottoms and including means defining a vertical slot in a rear portion thereof; and a one-piece retainer, said retainer having a first generally planar portion having a central axis, a second generally planar portion having a central axis parallel to said central axis of said first generally planar portion, and a connecting rib, wherein said first generally planar portion includes a first lower end, said first lower end being curved in a direction toward said second generally planar portion, thereby forming a lip;

said rib being parallel to and extending between said central axis of said first generally planar portion and said central axis of said second generally planar portion;

the sleeve, retainer and rib being dimensioned and configured such that said holder is assembled by inserting said retainer into said sleeve such that said first generally planar portion is inside said sleeve, said second generally planar portion is outside said sleeve and said connecting rib is within said slot.

2. The necktie holder as defined in claim 1, wherein said first generally planar portion includes a first lower end, said first lower end being curved in a direction toward said second generally planar portion, thereby to form a lip.

3. The necktie holder as defined in claim 2, wherein said lip is dimensioned to extend below said bottom of said sleeve when said retainer is inserted into said slot, thereby to hold the retainer and sleeve together.

4. The necktie holder as defined in claim 3, wherein:

said first generally planar portion includes a second upper end;

said second upper end is wider than said first lower end, said first generally planar portion being tapered from said upper end to said lower end; and said first lower end of said first generally planar portion is rounded.

5. The necktie holder as defined in claim 4, wherein said second generally planar portion is substantially rectangular in shape.

6. The necktie holder as defined in claim 5, wherein said connecting rib is trapezoidal in shape.

7. The necktie holder as defined in claim 6, wherein said retainer has an H-shaped cross section, said cross section being at a central location of said retainer and at right angles to said axes.

8. A method of making a necktie holder, said method comprising the steps of:

bending a one-piece, planar sheet into a frusto-conical shape to form a sleeve; and cutting a one-piece section of material having an H-shaped cross section, said material with an H-shaped cross section including a first planar portion connected to a second planar portion by a rib, thereby to form a retainer, wherein the first planar portion, the second planar portion, and the rib all have a first end, said cutting step further includes:

cutting the first end of said rib and the first end of the second planar portion flush with one another; and cutting the first end of the first planar portion such that the first end of the first planar portion extends farther than the flush first ends of the rib and the second planar portion.

9. The method as defined in claim 8, wherein the first planar portion, the second planar portion, and the rib all have a second end, and said cutting step further includes:

cutting the second end of the rib at a slant such that the rib is shorter at a point where it is connected to the second planar portion, and longer at a point where it is connected to the first planar portion.

10. The method as defined in claim 9, wherein said cutting step further includes:

cutting the second end of the first planar portion such that it extends farther than the second slanted end of the rib at the point where the rib is connected to the first planar portion; and cutting the second end of the second planar portion such that it extends slightly farther than the second slanted end of the rib at the point the rib is connected to the second planar portion.

11. The method as defined in claim , wherein said method further comprises the step of bending the second end of the first planar portion in a direction toward the second end of the second planar portion thereby to form a lip.

12. The method as defined in claim 11, wherein said method further comprises the step of rounding off the second end of the first planar portion to thereby taper the lip.

13. A necktie holder made by a method, said method comprising the steps of:

bending a one-piece, planar sheet into a frusto-conical shape to form a sleeve; and cutting a one-piece section of material having an H-shaped cross section, said material with an H-shaped cross section including a first planar portion connected to a second planar portion by a rib, thereby to form a retainer, wherein said first planar portion, said second planar portion, and said rib all have a first end, said cutting step further includes:

cutting said first end of said rib and said first end of said second planar portion flush with one another; and cutting said first end of said first planar portion such that said first end of said first planar portion extends farther than said flush first ends of said rib and said second planar portion.

14. The necktie holder made by the method as defined in claim 12, wherein said first planar portion, said second planar portion, and said rib all have a second end, said cutting step including:

cutting said second end of said rib at a slant such that said rib is shorter at a point where it is connected to said second planar portion, and longer at a point where it is connected to said first planar portion.

15. The necktie holder made by the method as defined in claim 14, wherein said cutting step further includes:

cutting said second end of said first planar portion such that it extends farther than said second slanted end of said rib at said point where said rib is connected to said first planar portion; and cutting said second end of said second planar portion so that it extends slightly farther than said second slanted end of said rib at said point said rib is connected to said second planar portion.

16. The necktie holder made by the method as defined in claim 15, wherein said method further comprises the step of bending said second end of said first planar portion in a direction toward said second end of said second planar portion, thereby to form a lip.

17. The necktie holder made by the method as defined in claim 16, wherein said method further comprises the step of rounding off said second end of said first planar portion, thereby to taper said lip.

* * * * *